US007156171B2

(12) United States Patent
Gremillion

(10) Patent No.: US 7,156,171 B2
(45) **Date of Patent: *Jan. 2, 2007**

(54) DUAL DIAMETER AND ROTATING CENTRALIZER/SUB

(75) Inventor: Maximillian S. Gremillion, Missouri City, TX (US)

(73) Assignee: CaseTech International, Inc., Houston, TX (US)

( * ) Notice: Subject to any disclaimer, the term of this patent is extended or adjusted under 35 U.S.C. 154(b) by 173 days.

This patent is subject to a terminal disclaimer.

(21) Appl. No.: 10/719,313

(22) Filed: Nov. 21, 2003

(65) Prior Publication Data

US 2004/0112592 A1 Jun. 17, 2004

Related U.S. Application Data

(63) Continuation-in-part of application No. 10/302,641, filed on Nov. 23, 2002, which is a continuation-in-part of application No. 09/655,795, filed on Sep. 6, 2000, now Pat. No. 6,484,803.

(51) Int. Cl.
*E21B 17/10* (2006.01)

(52) U.S. Cl. ..... 166/241.6; 166/241.1; 166/242.6

(58) Field of Classification Search ..... 166/241.6, 166/241.1, 241.7, 242.6; 175/325.5, 325.1, 175/325.2

See application file for complete search history.

(56) References Cited

U.S. PATENT DOCUMENTS

| | | | | |
|---|---|---|---|---|
| 350,655 | A | 10/1886 | Brooder | |
| 1,314,070 | A | 8/1919 | McKissick | |
| 1,565,518 | A | 12/1925 | Smyser | |
| 1,767,198 | A | 6/1930 | Baker | |
| 1,775,376 | A | 9/1930 | Steps et al. | |
| 1,812,945 | A | 7/1931 | Granger | |
| 1,998,833 | A | 4/1935 | Crowell | |
| 2,058,310 | A | 10/1936 | Hartman et al. | |
| 2,089,553 | A | 8/1937 | Hartman et al. | |
| 2,258,052 | A | 10/1941 | Hall | |
| 2,311,768 | A | 2/1943 | McCray | |
| 2,546,582 | A * | 3/1951 | Baker | 166/241.6 |

(Continued)

FOREIGN PATENT DOCUMENTS

| | | |
|---|---|---|
| DE | 89 03 038.9 | 5/1989 |

(Continued)

OTHER PUBLICATIONS

Patent Litigation: *Weatherford International, Inc. and Weatherford/Lamb, Inc., Plaintiffs*, v. *Casetech International, Inc., Defendant*. Civil Action No. H-03-CV-05383, In the United States District Court For the Southern District of Texas, Houston Division.

(Continued)

*Primary Examiner*—George Suchfield
(74) *Attorney, Agent, or Firm*—Gordon G. Waggett, P.C.

(57) ABSTRACT

A centralizer for maintaining stand-off and/or centralizing a tubular member inside a larger diameter tubular member, for instance, in a wellbore. The centralizer is provided with bow springs that compress to a minimal diameter around the outer diameter of the sub to which the centralizer is concentrically mounted when compressive force is applied to the bow springs to facilitate insertion of the centralizer into restricted openings and/or flow control or wellhead equipment. The minimal diameter of the centralizer is provided by mounting the bow springs to a reduced diameter portion of the collar that is mounted to the sub, and even greater reduction in diameter is achieved by mounting the bow springs in notches formed in the reduced diameter portion of the collar.

20 Claims, 7 Drawing Sheets

U.S. PATENT DOCUMENTS

| | | | | | |
|---|---|---|---|---|---|
| 2,605,844 | A | | 8/1952 | Clark, Jr. | |
| 2,628,682 | A | | 2/1953 | Wright | |
| 2,640,544 | A | | 6/1953 | Baker | |
| 2,665,762 | A | | 1/1954 | Althouse, Jr. | |
| 2,666,241 | A | | 1/1954 | Hall, Sr. | |
| 2,718,266 | A | | 9/1955 | Berry, et al. | |
| 2,824,613 | A | | 2/1958 | Baker et al. | |
| 2,828,824 | A | | 4/1958 | Comstock | |
| 2,845,128 | A | | 7/1958 | Clark, Jr. et al. | |
| 2,898,136 | A | | 8/1959 | Hall, Sr. et al. | |
| 2,962,313 | A | | 11/1960 | Conrad | |
| 2,986,471 | A | | 5/1961 | Baker | |
| 2,998,848 | A | | 9/1961 | Wright et al. | |
| 3,065,005 | A | | 11/1962 | Hall, Sr., et al. | |
| 3,072,195 | A | | 1/1963 | Kluck | |
| 3,128,827 | A | | 4/1964 | Kluck | |
| 3,172,475 | A | | 3/1965 | Moore | |
| 3,196,951 | A | * | 7/1965 | Saurenman | 166/241.6 |
| 3,196,952 | A | | 7/1965 | Solum | |
| 3,200,884 | A | | 8/1965 | Solum | |
| 3,235,295 | A | | 2/1966 | Solum | |
| 3,237,696 | A | | 3/1966 | Hall | |
| 3,289,768 | A | | 12/1966 | Solum | |
| 3,316,951 | A | | 5/1967 | Jacobson et al. | |
| 3,360,846 | A | | 1/1968 | Schellstede et al. | |
| 3,556,042 | A | | 1/1971 | Laughlin | |
| 3,578,084 | A | | 5/1971 | Bombardieri et al. | |
| 3,614,139 | A | | 10/1971 | Harrison | |
| 3,978,924 | A | | 9/1976 | Roesner | |
| 4,011,907 | A | | 3/1977 | Clay | |
| 4,021,083 | A | | 5/1977 | Anderson | |
| 4,031,969 | A | | 6/1977 | Cullen et al. | |
| 4,039,026 | A | * | 8/1977 | Yonker | 166/117.5 |
| 4,042,022 | A | | 8/1977 | Wills et al. | |
| 4,077,470 | A | | 3/1978 | Dane | |
| 4,088,186 | A | * | 5/1978 | Callihan et al. | 166/241.7 |
| 4,105,262 | A | | 8/1978 | Richey | |
| 4,133,470 | A | | 1/1979 | Trail | |
| 4,363,360 | A | | 12/1982 | Richey | |
| 4,520,869 | A | | 6/1985 | Svenson | |
| 4,523,640 | A | | 6/1985 | Wilson et al. | |
| 4,531,582 | A | | 7/1985 | Muse et al. | |
| 4,566,317 | A | | 1/1986 | Shakra | |
| 4,630,690 | A | | 12/1986 | Beasley et al. | |
| 4,651,823 | A | * | 3/1987 | Spikes | 166/241.7 |
| 4,688,636 | A | | 8/1987 | Hennessey | |
| 4,739,842 | A | | 4/1988 | Kruger et al. | |
| 4,787,458 | A | | 11/1988 | Langer | |
| 4,794,986 | A | | 1/1989 | Langer | |
| 4,880,066 | A | | 11/1989 | Steiginga et al. | |
| 4,984,633 | A | | 1/1991 | Langer et al. | |
| 4,995,456 | A | | 2/1991 | Cornette et al. | |
| 5,095,981 | A | | 3/1992 | Mikolajczyk | |
| H1192 | H | | 6/1993 | Keller | |
| 5,238,062 | A | | 8/1993 | Reinholdt | |
| 5,261,488 | A | | 11/1993 | Gullet et al. | |
| 5,339,896 | A | | 8/1994 | Hart et al. | |
| 5,575,333 | A | | 11/1996 | Lirette et al. | |
| 6,032,748 | A | * | 3/2000 | DeBray et al. | 175/325.7 |
| 6,209,638 | B1 | | 4/2001 | Mikolajczyk | |
| 6,457,519 | B1 | * | 10/2002 | Buytaert | 166/241.6 |
| 6,484,803 | B1 | | 11/2002 | Gremillion | |
| 6,679,325 | B1 | * | 1/2004 | Buytaert | 166/241.3 |

FOREIGN PATENT DOCUMENTS

| | | |
|---|---|---|
| EP | 00143219 | 6/1985 |
| GB | 664905 | 1/1952 |
| GB | 682292 | 11/1952 |
| GB | 682489 | 11/1952 |
| GB | 689807 | 4/1953 |
| GB | 698464 | 10/1953 |
| GB | 2249333 A | 5/1992 |
| GB | 2366580 | 3/2002 |

OTHER PUBLICATIONS

Ray Oil Tool Company—The Centralization Specialists—rayoiltool.com—one page product brochure regarding Bi-Centered Float Shoes, Collars & Inline Tyupe Centralizers printed from this website on Sep. 13, 2004, but same material was printed previously from website on Feb. 25, 2003. Date of origin of this material and webiste is not known.

Patent Litigation: *Weatherford International, Inc. and Weatherford / Lamb, Inc., Plaintiffs, v. Casetech International, Inc., Defendant*. Civil Action No. H-03-CV-05383, In the United States District Court For the Southern District of Texas, Houston Division. "Claim Construction Memorandum and Order", Aug. 12, 2005, 10 pages.

Composite Catalog of Oil Field Equipment & Services, 26th Revision, 1964-65, vol. 1, Published by World Oil, p. 460: Baker Model "B" Hammer-Lok Stop Rings. (2 pages).

Kinzel, Holger and Calderoni, Angelo, "Field Test of a Downhole-Activated Centralizer To Reduce Casing Drag", Society of Petroleum Engineers, 1995 (3 pages).

Kinzel, Holger and Martens, James G., "The Application of New Centralizer Types to Improve Zone Isolation in Horizontal Wells", SPE 50438, Society of Petroleum Engineers, 1998, pp. 673-682.

Information Disclosure Statement filed on Apr. 6, 2006 in Ex Parte Re-exam of Lirette, U.S. Appl. No. 5,575,333 (Control No. 5,575,333 (control No. 9/077,870 (27 pgs).

Halliburton's Patent Opinion on related U.S. Appl. No. 10/302,641 w/exhibits dated May 15, 2006 (62pgs).

Baker, Ron, A Primer of Oilwell Drilling, pp. 119-146, 137 (6thEd. 2001).

Ray Oil Tool Company - The Centralization Specialists - rayoiltool.com - one page product brochure regarding Bi-Centered Float Shoes, Collars & Inline Type Centralizers printed from this website on Sep. 13, 2004, but same material was printed previously from website on Feb.25, 2003. Date of origin of this material and website is not known.

* cited by examiner

DUAL DIAMETER AND ROTATING CENTRALIZER/SUB

CROSS REFERENCE TO RELATED APPLICATION

The present application is a continuation-in-part of co-pending application Ser. No. 10/302,641, DUAL DIAMETER AND ROTATING CENTRALIZER/SUB AND METHOD, filed Nov. 23, 2002. Ser. No. 10/302,641 is itself a continuation-in-part of application Ser. No. 09/655,795, filed Sep. 6, 2000, and having the same title, now issued as U.S. Pat. No. 6,484,803, and Applicant hereby claims the benefit of the earlier filing dates of both prior applications under 35 U.S.C. 120.

BACKGROUND OF THE INVENTION

The present invention relates to a centralizer for use in wellbore operations. More specifically, the present invention relates to a centralizer with compressible bow springs, particularly a stabilizer that is used in relatively small annular spaces and which also expands for use in a larger annular space. In another aspect, the present invention relates to a centralizer that provides a minimum standoff and/or centralization in portions of a wellbore in which known bow spring centralizers cannot provide adequate standoff because the bow springs lack sufficient restoring force.

Bow spring centralizers are used to center one tubular member inside a borehole or other tubular member, e.g., to center a first smaller tubular member in a second, larger diameter, tubular member (for instance, a tubing string inside a casing in a borehole). Typically, centralizers are run into the borehole on the exterior of an inner tubular member or tubing string and the bow springs project radially outwardly from the outside diameter (O.D.), or surface, of the smaller tubular member into contact with the inside diameter (I.D.), or surface, of the larger diameter tubular. However, there are at least two disadvantages of prior known centralizers in that they tend to restrict fluid flow in the annular space between centralizer O.D. and the I.D. of the tubular member and, in the event the smaller diameter tubular member needs to be rotated inside the larger diameter tubular member (if, for instance, it becomes stuck during running), rotating tends to damage the bow springs of such centralizers.

Another disadvantage of many known centralizers is illustrated by reference to the many wells that include a portion that is cased and a portion that is not cased, wells in which the diameter of the bore changes, or wells that include one or more lateral bores. Downhole operations must, of course, be conducted in cased, uncased, different diameter, and/or lateral bores. In such wellbores, the centralizer must pass through a portion of the bore that is relatively small and then down through a portion that is smaller, with the centralizing function needed in the larger diameter, deeper portion of the wellbore. So far as is known, no centralizer is available that is capable of both being run into such bores and then also providing effective centralizing in a larger diameter portion of the wellbore. Similarly, no centralizer is known that provides effective centralizing in bores of both diameters.

Another limitation of known centralizers occurs in the curved portion of a wellbore. In such wellbores, the weight of the tubing or pipe to which the centralizer is mounted can exceed the restoring force of the bow springs such that the tubing or pipe bears against the side of the wellbore. This same problem of the weight of the tubing affects lateral bores, restricting fluid flow and preventing the rotation of the tubing string. There is, therefore, a need for, and it is an object of the present invention to provide, a centralizer that positions the tubing or pipe string off the side of the wellbore in the curved or the horizontal portion of a wellbore and a centralizer that allows rotation of the tubing string in the wellbore.

Another limitation of known centralizers occurs when the wellbore, or a portion of the wellbore, wellhead, or flow control equipment is of relatively small diameter. When introduced into such restrictions, the bow springs of known centralizers must be highly compressed, creating substantial resistance to entry of the centralizer into the wellbore and/or the running of the centralizer in the wellbore. Further, because of the increased tendency of the bow springs to return to their uncompressed state as a result of their high compression, the likelihood that the centralizer will catch and hang up in the wellbore, wellhead, or flow control equipment is increased. The high compression that is required in such restrictions in the wellbore is sometimes even enough to overcome the restoring force of the bow springs such that the bow springs are unable to return to their uncompressed state. There is, therefore, a need for a centralizer that provides effective centralizing in a wellbore that is capable of being run into even small diameter wellbores and/or restrictions in the wellbore, and it is an object of the present invention to provide a centralizer that functions effectively even when run through such restrictions in the wellbore.

It is also an object of the present invention to provide positive centralization in areas of the wellbore where a bow spring is not strong enough to position the pipe or tubing string off the side of the well bore but also provide standoff in less severe portions of the borehole.

Another object of the present invention is to provide a centralizer that functions in both a large and/or small diameter annulus and/or wellbore.

Another object of the present invention is to provide a centralizer that maintains both standoff from the wall of the borehole and fluid flow through the borehole.

Yet another object of the present invention is to provide a centralizer that can be run into a borehole through a borehole of small diameter, e.g., a cased portion of the borehole, that also functions to center the tubing in a portion of the borehole having a diameter larger than the small diameter portion such as an uncased portion of the borehole.

Other objects, and the advantages, of the present invention will be made clear to those skilled in the art by the following description of a presently preferred embodiment thereof.

SUMMARY OF THE INVENTION

These objects are achieved by providing a centralizer adapted for concentric mounting on a sub, the sub having a shoulder formed on the outside diameter thereof, comprising a collar having a groove formed in the inside surface thereof adapted for receiving the shoulder formed on the outside diameter of the sub therein when concentrically mounted on the sub to limit longitudinal movement of the collar along the sub. The collar may also be provided with a portion of reduced outside diameter to which a plurality of bow springs are mounted, the bow springs being maintained in spaced relation to the sub whereby one or more of the bow springs moves between a first, bowed position standing off from the body to a second compressed position closer to the body. In one preferred embodiment, the ends of the bow springs are mounted to the reduced diameter portion of the collar in notches formed in the reduced diameter portion of the collar, thereby reducing the diameter of the centralizer enough that movement of the centralizer through reduced diameter portions of the borehole and/or wellhead equipment is facilitated.

In another aspect, the present invention provides an apparatus for centralizing a tubular member comprising a tubular member with a collar mounted concentrically thereon. A shoulder is formed on the tubular member and a groove is formed in the collar for receiving the shoulder on the tubular member. A plurality of bow springs, each bow spring being compressible from a first, bowed position standing off from the tubular member to a second compressed position closer to the tubular member are mounted to the collar.

In yet another aspect, the present invention provides an apparatus for centralizing a tubular member comprising a tubular member having spaced apart annular shoulders formed thereon with first and second collars mounted concentrically on the tubular member. A groove is formed in each collar for receiving the respective shoulder on the tubular member to limit movement of the collars along the length of the tubular member and a plurality of bow springs are mounted to the collars by welding the ends of the bow springs to the two collars, each of the bow springs being compressible from a first, bowed position standing off from the tubular member to a second compressed position closer to the tubular member.

DETAILED DESCRIPTION OF THE PREFERRED EMBODIMENTS

Figure 1:
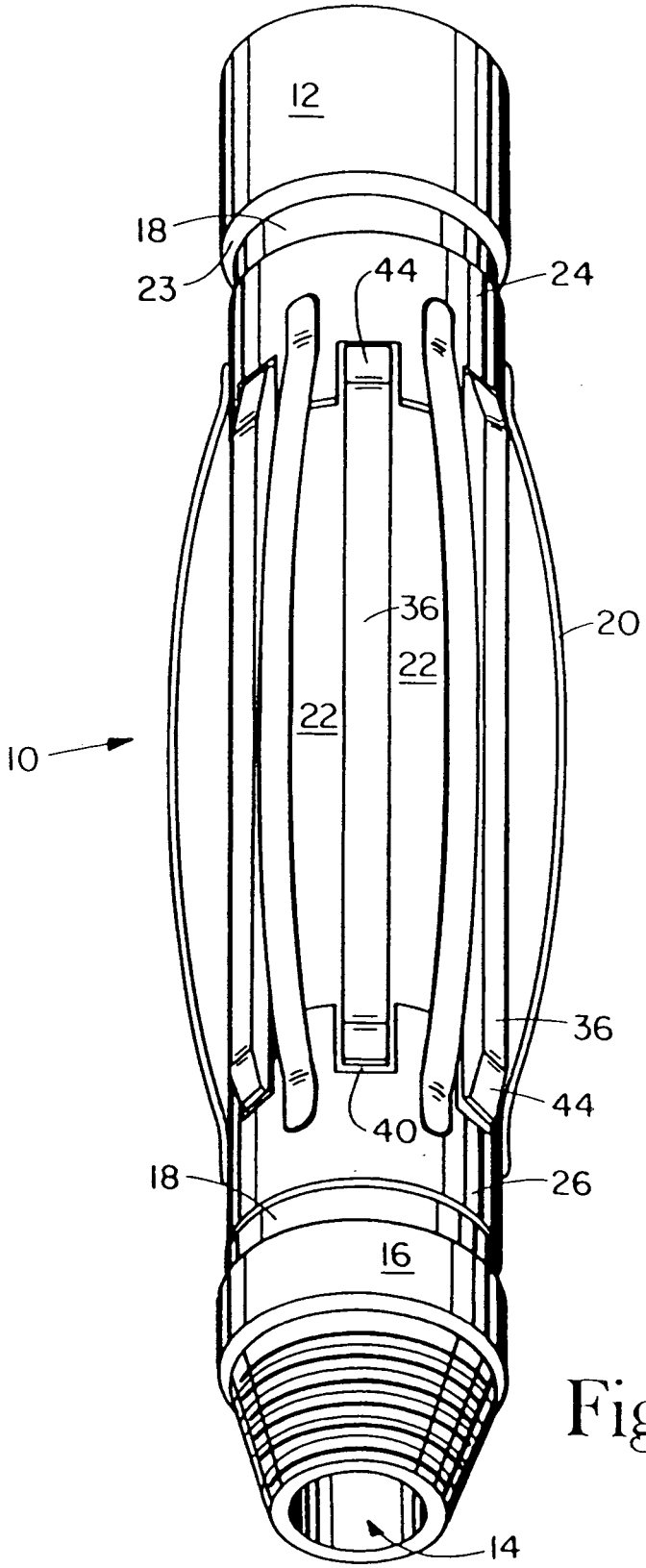
FIG. 1 is a perspective view of a preferred embodiment of a centralizer constructed in accordance with the teachings of the present invention.

Referring to FIG. 1, a preferred embodiment of a centralizer constructed in accordance with the teachings of the present invention is indicated generally at reference numeral 10. In the embodiment shown, centralizer 10 is comprised of a tubular body 12 having a bore 14 therethrough and an outer surface, or O.D., 16. The O.D. 16 of body 12 is provided with a groove 18 in which the first and second collars 24, 26 are movably disposed, the ends 28 of a plurality of bow springs 20 being affixed to each of collars 24, 26 by, for instance, welding or other suitable means of attachment. Bow springs 20 are spaced apart around the collars 24, 26. Although not shown in the figures, those skilled in the art who have the benefit of this disclosure will recognize that one or both of collars 24, 26 move apart from each other when the bow springs are moved from the first, bowed position standing off from said body as shown in FIG. 1 to a second, compressed position closer to body 12 as centralizer 10 performs its function of maintaining stand-off between a tubing string and the wall of a borehole. Depending upon the bow in bow springs 20 and the spacing between the margins of collars 24, 26, the shoulder 23 marking the change in the diameter of the O.D. 16 of body 12 from the larger diameter portion to the smaller diameter of groove 18 functions as a stop that abuts one or both of collars 24, 26 when moved in response to contact between the bow springs 20 and the inside diameter of another member, e.g., a larger casing (not shown in FIG. 1 but described in detail in connection with FIGS. 5 and 6, infra).

Figure 3:
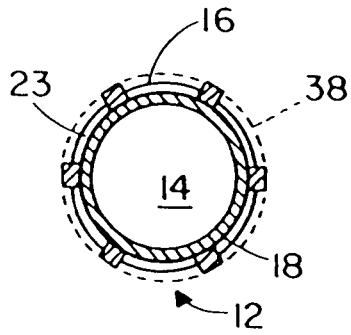
FIG. 3 is a cross-sectional view of the body of the FIG. 2 taken at the line 3—3 in FIG. 2.
Figure 2:
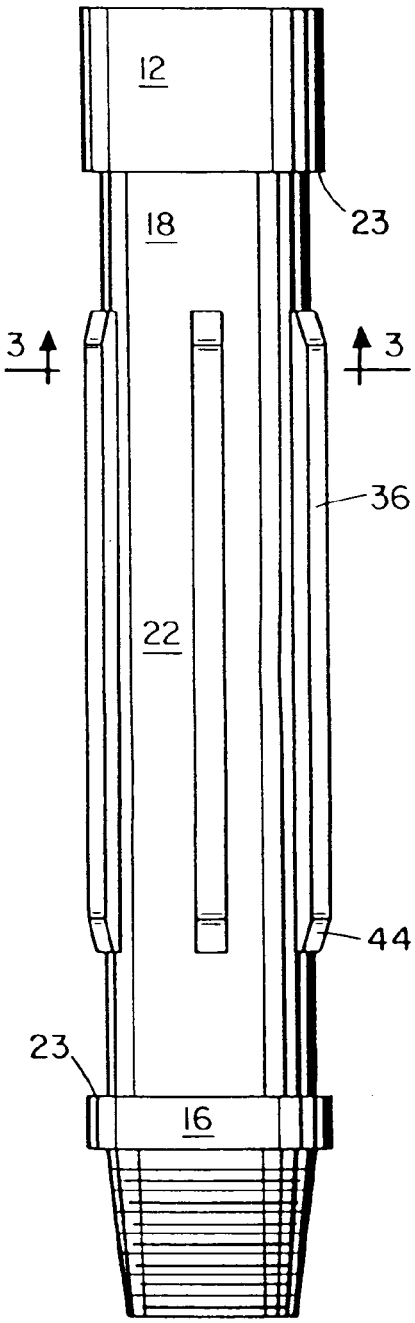
FIG. 2 is an elevational view of the body of the centralizer of FIG. 1 having the bow springs removed therefrom to show the vanes on the outside diameter of the body.

As shown in FIGS. 2 and 3, the body 12 is provided with a plurality of radially outwardly extending vanes 36 on the outside surface of body 12 in the area of groove 18. Vanes 36 may be milled into body 12 but it is preferred (for cost saving in manufacture) to weld the vanes 36 to the surface 16 of body 12. As best shown in FIG. 1, the spaces between vanes 36 provide grooves 22 for receipt of the bow springs 20 as bow springs 20 are compressed from the first, bowed position standing off from said body shown in FIG. 1 to the above-described second, compressed position closer to body 12. Although described herein as first and second positions, those who are skilled in the art will recognize from this disclosure that the designation of first and second positions for bow springs 20 is arbitrary, chosen for the purpose of facilitating the description of the grooves 22 between vanes 36, and that the position of the bow springs 20 is a continuum depending upon the degree of compression applied to bow springs 20 by contact with the inside diameter of another tubular member or a borehole. Referring now to FIG. 3, it can be seen that the vanes 36 extend radially outwardly from the surface 16 of body 12 in the area of groove 18 far enough that the effective diameter (shown in shadow lines 38 in FIG. 3) of the body 12 in the area to which the vanes 36 are mounted is greater than the diameter of both (a) the portion of body 12 in the area of groove 18 and (b) the portion of body 12 above and below groove 18 for a purpose to be explained below.

Figure 4:
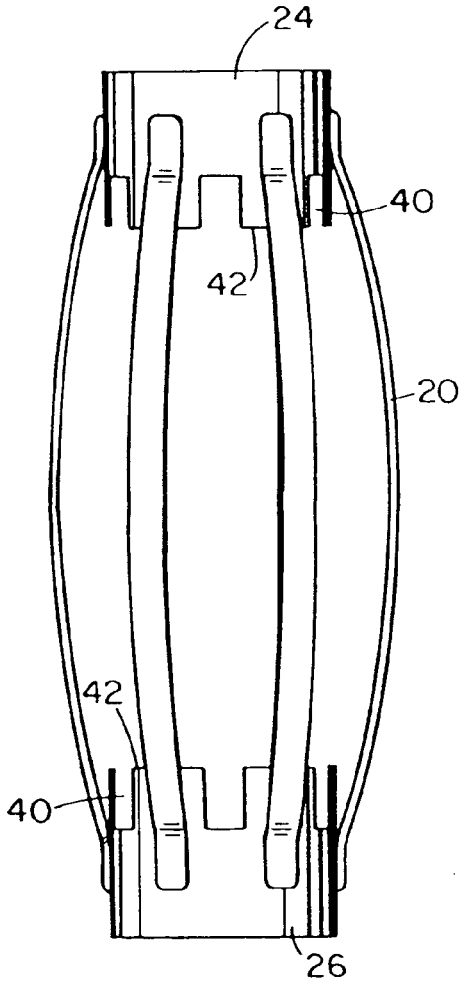
FIG. 4 is an elevational view of the bow springs of the centralizer of FIG. 1 removed from the body thereof.

As shown in FIG. 4, the collars 24, 26 to which bow springs 20 are attached are provided with a plurality of cut-outs 40 in their opposed margins 42 such that the collars 24, 26 are castellated. Referring also to FIG. 1, it can be seen that the number of cut-outs 40 spaced radially around the opposed margins 42 of collars 24, 26 is the same as the number of vanes 36 mounted to body 12 and that each cut-out 40 receives the end 44 of a respective vane 36, thereby preventing relative rotation between body 12 and the assembly comprised of the bow springs 20 and collars 24, 26. Similarly, the depth of the cut-outs 40 in collars 24, 26 is such that, when the bow springs 20 move from the first, bowed position to the second position close to the body 12 in the grooves 22 between vanes 36 and first and second collars 24, 26 move apart from each other in groove 18, the collars 24, 26 do not rotate relative to body 12. In other words, the interaction of the ends 44 of vanes 36 and the cut-outs 40 prevents relative rotational movement between body 12 and the bow spring 20/collar 24, 26 assembly when bow springs 20 are in both their first, bowed and their second, compressed positions.

Figure 5A:
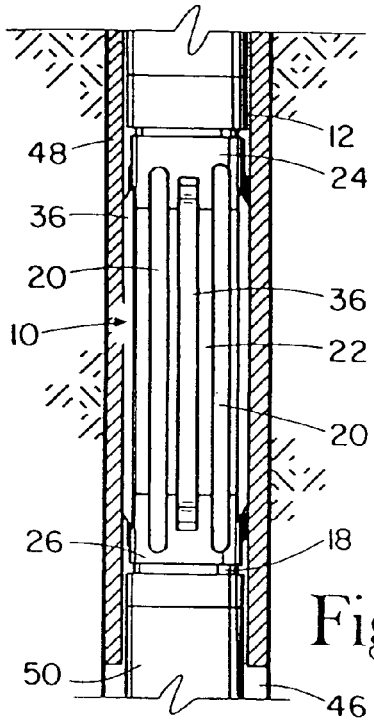
FIGS. 5A and 5B are longitudinal sectional views of a wellbore having the centralizer of FIG. 1 being run therein in casing (FIG. 5A) and without casing (FIG. 5B).
Figure 5B:
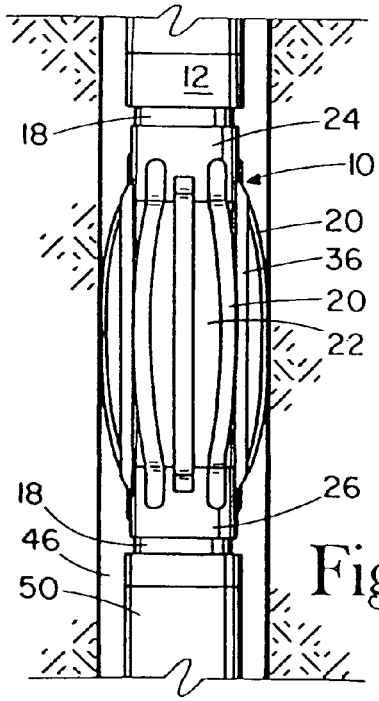

FIG. 5 shows the preferred embodiment of the centralizer 10 of the present invention being run into a cased (FIG. 5A) and uncased (FIG. 5B) borehole 46. Referring first to FIG. 5A, the bow springs 20 are compressed into the spaces 22 between vanes 36 in the area of borehole 46 that is lined with casing 48. In the portion of borehole 46 that is uncased, the bow springs 20 expand to the first, bowed position to center the tubing string 50 to which centralizer 10 is mounted in the borehole 46.

Figure 6:
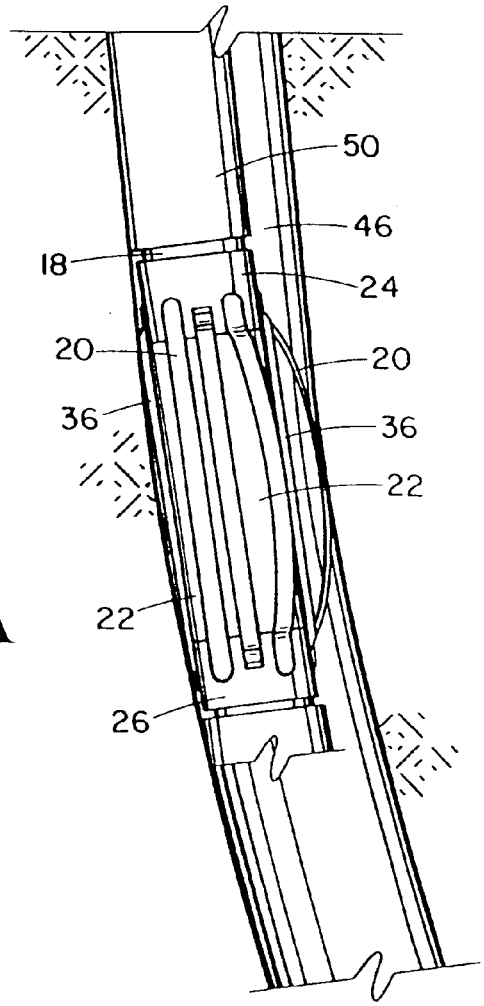
FIG. 6 is a longitudinal view of a curved portion of a wellbore having the centralizer of FIG. 1 run therein.

Referring now to FIG. 6, there is shown a curved borehole 46 (the curve is exaggerated for purposes of illustration) with a tubing string 50 therein having the preferred embodiment of the centralizer of the present invention mounted thereto. Even though the bow spring 20 is compressed into the space 22 between vanes 36 on the larger radius side of the borehole, a minimum stand-off is maintained by the bearing of the vanes 36 against the wall of the borehole on the larger radius side of borehole 46, thereby maintaining fluid flow past the centralizer 10 and reducing abrasive wear on tubing string 50. As shown by the bowed position of bow spring 20 on the shorter radius side of borehole 46, the centralizer 10 of the present invention functions to center tubing string 50 even in the curved portion of the borehole 46.

Figure 7:
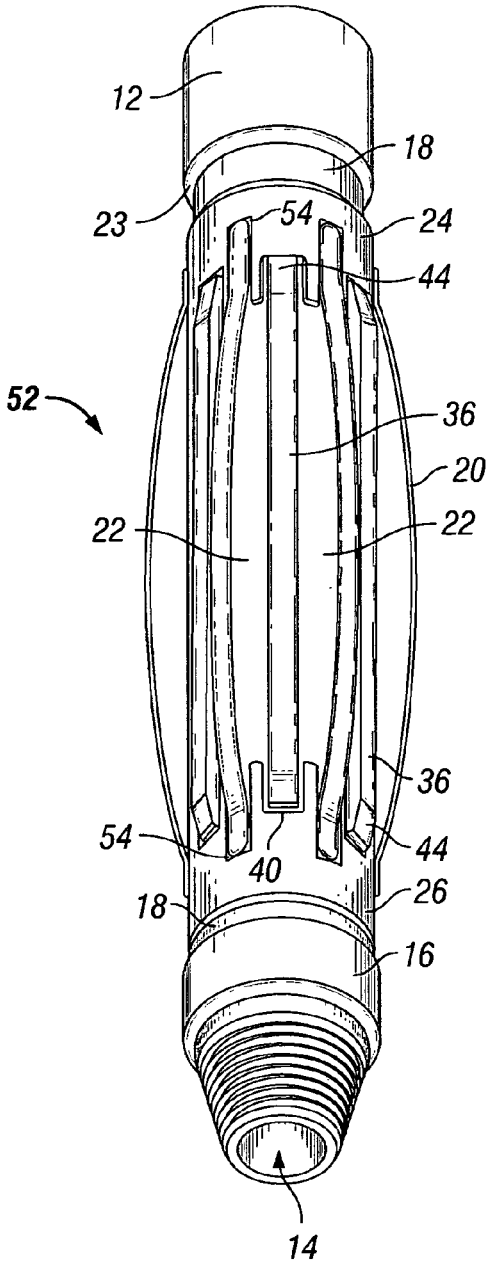
FIG. 7 is a perspective view of a second embodiment of a centralizer constructed in accordance with the teachings of the present invention.
Figure 8:
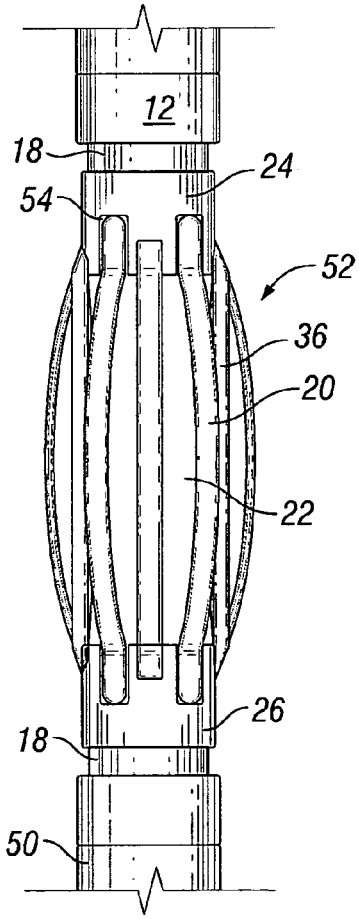
FIG. 8 is an elevational view of the centralizer of FIG. 7.

Referring now to FIGS. 7 and 8, a second embodiment of the centralizer of the present invention is shown that, because of its smaller total diameter, is particularly useful in smaller diameter boreholes and/or when avoiding a restriction in fluid flow is of paramount importance. In this second embodiment, indicated generally at reference numeral 52 and in which like parts are referred to by the same reference numerals as set out in FIGS. 1–6, the ends 28 of bow springs 20 are welded to the collars 24, 26 in the notches 54 in the opposed margins 42 of each collar 24, 26 instead of being welded to the surface, or O.D., of the first and second collars 24, 26 as in the embodiment shown in FIGS. 1–6. The result of welding the ends 28 into notches 54 is that the effective diameter of centralizer 52 is reduced (relative to the diameter of centralizer 10 shown in FIGS. 1–6) by at least the thickness of the metal comprising the collars 24, 26 for use in smaller diameter boreholes. As with the centralizer 10 shown in FIGS. 1–6, the same number of cut-outs 40 are spaced radially around the opposed margins 42 of collars 24, 26 as the number of vanes 36 that are mounted to body 12, and each cut-out 40 receives the end 44 of a respective vane 36, thereby preventing relative rotation between body 12 and the assembly comprised of the bow springs 20 and collars 24, 26. Similarly, the depth of the cut-outs 40 in collars 24, 26 is such that, when the bow springs 20 move from the first, bowed position to the second position close to the body 12 in the grooves 22 between vanes 36 and first and second collars 24, 26 move apart from each other in groove 18, the collars 24, 26 do not rotate relative to body 12. In short, relative rotational movement between body 12 and the bow spring 20/collar 24, 26 assembly is prevented when bow springs 20 are in both their first, bowed and their second, compressed positions by the interaction of the ends 44 of vanes 36 and the cut-outs 40 in the same manner as described in connection with the embodiment 10 shown in FIGS. 1–6.

It will also be recognized by those skilled in the art that the second embodiment 52 shown in FIG. 7 can be constructed so as to allow relative rotation between body 12, and hence, a tubing string (not shown in FIG. 7) and the assembly comprised of bow springs 20 and collars 24, 26. Referring specifically to FIG. 8, it can be seen that when the bow springs 20 are mounted in the notches 54 in collars 24, 26, the bow springs are "low enough" relative to the vanes 36 that relative rotation between body 12 and the assembly comprised of bow springs 20 and collars 24, 26 is prevented by contact between bow springs 20 and vanes 36. Although the particular embodiment 52 shown in FIGS. 7 and 8 does include them, because the bow springs 20 contact the vanes 36, it is not necessary to include cut-outs (such as the cut-outs 40 in the opposed margins 42 of collars 24, 26 shown in FIG. 4) to prevent rotation between the bow springs/collars 24, 26 assembly and body 12. By consideration of the embodiment shown in FIG. 8, it will be recognized that it is possible to mount the bow springs 20 to collars 24, 26 in notches 54 that extend far enough apart, and/or to bow the bow springs 20 far enough outwardly from the surface, or O.D., of body 12 that the bow springs 20 do not contact the vanes 36 when in their first, bowed position standing off from the body 12, thereby allowing rotation of the body 12 relative to the collar 24, 26/bow spring 20 assembly when the bow springs 20 are in that first, bowed position. When compressed radially inwardly to the second, compressed position, the bow springs 20 of such an embodiment do contact the vanes 36 to prevent rotation of the bow spring 20/collars 24, 26 assembly relative to body 12.

Those skilled in the art will also be aware of the utility of a centralizer that allows the tubing string to rotate relative to the bow springs at any desired time, regardless of whether the bow springs are in the first, uncompressed position or the second, compressed position. Referring now to FIGS. 9–12, four embodiments of such centralizers are shown at reference numerals 56, 58, 60, and 64, respectively. Again, like parts shown in FIGS. 7 –8, the component parts of the rotating bow spring centralizers shown in FIGS. 9–12 are numbered in accordance with the reference numerals of the embodiments shown in FIGS. 1 –6. In the embodiment shown in FIG. 9, the assembly comprised of the bow springs 20 and collars 24, 26 is mounted to body 12 and retained thereon by engagement of the opposed margins 42 of coliars 24, 26 with the shoulders 62 on the O.D. of body 12. The centralizer 58 shown in FIG. 9 functions to centralize the tubing string (not shown) in a borehole in the same manner as the embodiments shown in FIGS. 1–8, but the assembly comprised of bow springs 20 and coliars 24, 26 is free to rotate around the body 12 at all times, thereby allowing rotation of the tubing string, regardless of whether the bow springs 20 are in the first or second positions, while maintaining the required stand-off from the I.D. of the borehole.

Figure 9:
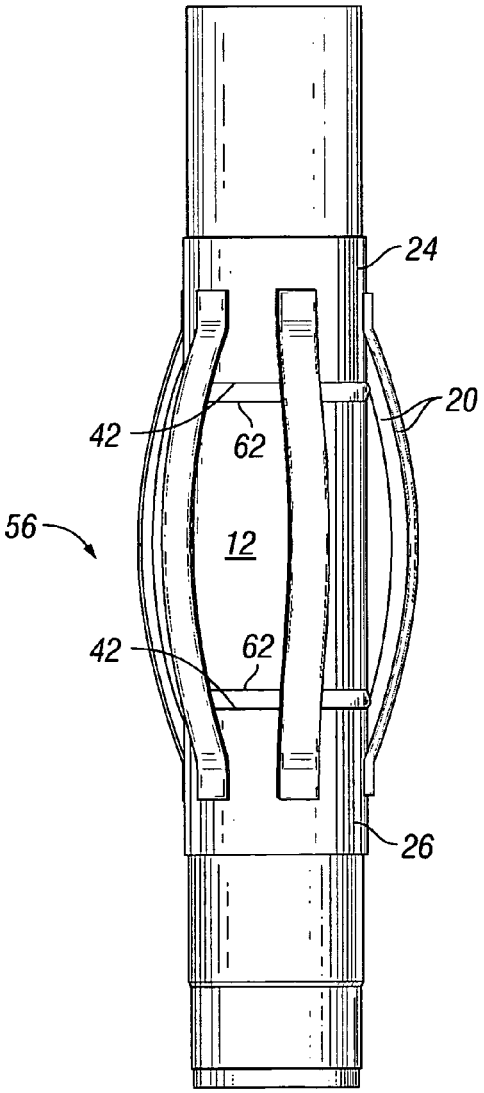
FIG. 9 is an elevational view of a first embodiment of a rotating bow spring centralizer constructed in accordance with the teachings of the present invention.
Figure 10:
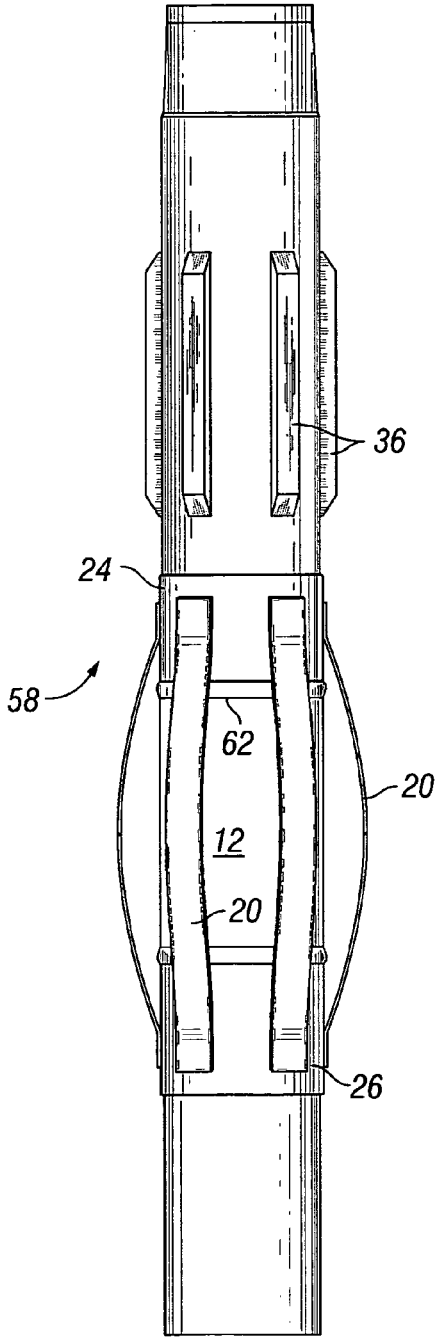
FIG. 10 is an elevational view of a second embodiment of a rotating bow spring centralizer constructed in accordance with the teachings of the present invention.
Figure 11:
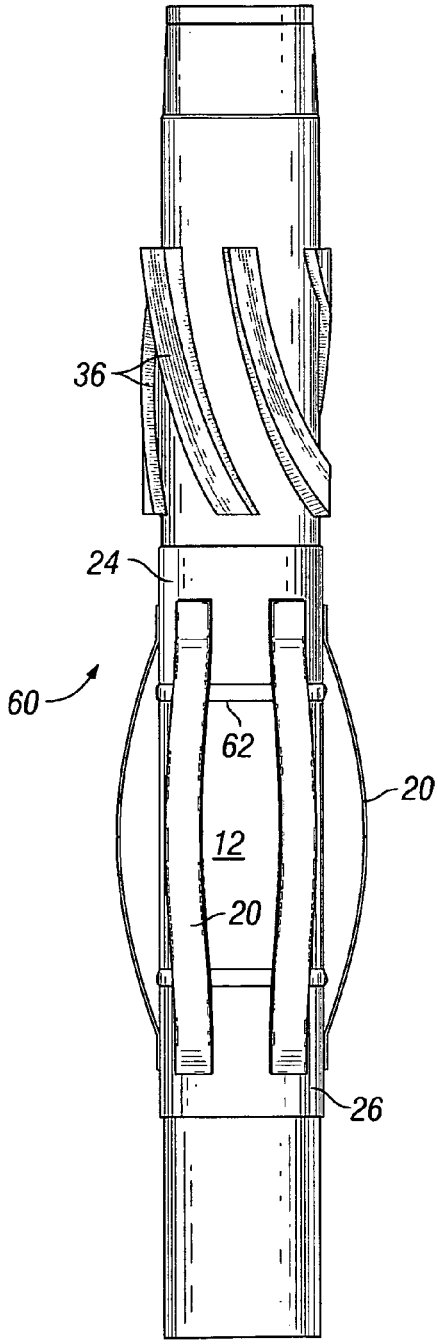
FIG. 11 is an elevational view of a third embodiment of a rotating bow spring centralizer constructed in accordance with the teachings of the present invention.

The embodiment 58 shown in FIG. 10 includes the same rotating bow spring assembly as shown in FIG. 9, but the rotating bow spring assembly (comprised of collars 24, 26 and bow springs 20) is spaced longitudinally on the body 12 from the set of vanes 36 that are mounted to the O.D. of body 12. The collar 24, 26/bow spring 20 assembly is retained in this longitudinally spaced position on body 12 by engagement of the shoulders 62 formed on body 12 by the opposed margins 42 of collars 24, 26 in the same manner as described above in connection with the embodiment shown in FIG. 9. Because of the presence of both the bow springs 20 and the vanes 36, the embodiment 58 shown in FIG. 10 is capable of performing in the same manner as the embodiment shown in FIGS. 1–6 to maintain fluid flow and stand-off from the I.D. of the borehole, but has the additional advantage of allowing rotation of the body 12 (and hence a tubing string) relative to the centralizer 58. Similarly, the embodiment 60 shown in FIG. 11 includes the same component parts as the embodiment 58 shown in FIG. 10, but the vanes 36 of the centralizer 60 are angled and spiraled so as to "turbolate" fluid flow past the centralizer 60, thereby assisting in maintaining fluid flow in the borehole.

Figure 12:
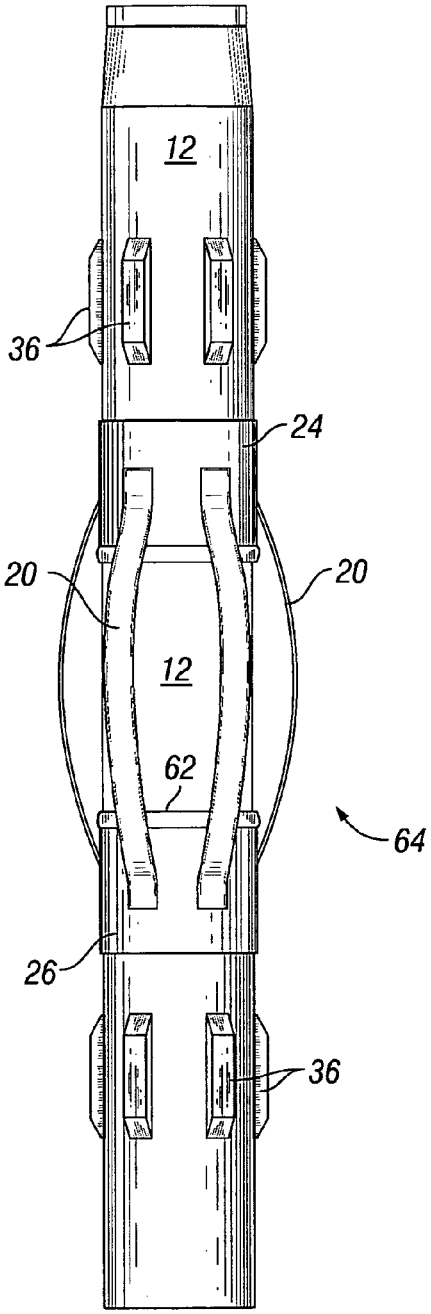
FIG. 12 is an elevational view of a fourth embodiment of a rotating bow spring centralizer constructed in accordance with the teachings of the present invention.

The embodiment 64 shown in FIG. 12 is similar, but is comprised of two sets of vanes 36 having the assembly comprised of bow springs 20 and collars 24, 26 mounted to the body 12 between the two sets of vanes 36. Although shown in FIG. 12 as being retained in that longitudinally spaced position between the two sets of vanes 36 by the interaction of the opposed margins 42 of collars 24, 26 and shoulders 62, those skilled in the art will recognize that the shoulders 62 are not required for that purpose and that the collar/bow spring assembly is effectively trapped between the sets of vanes 36 by the interaction of the ends of the collars 24, 26 and the ends 44 of the vanes 36.

Figure 14:
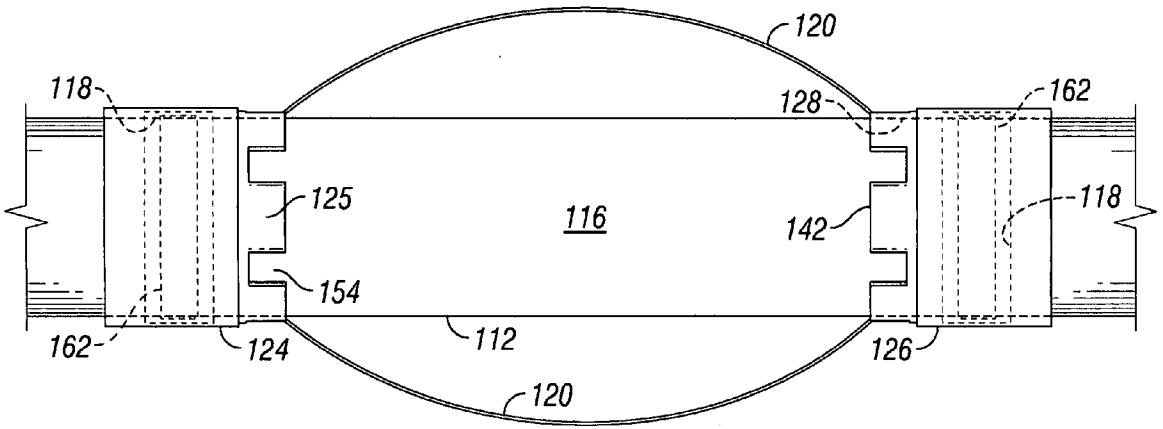
FIG. 14 is a longitudinal sectional view of the centralizer of FIG. 13; again, several of the bow springs are not shown for purposes of clarity.
Figure 13:
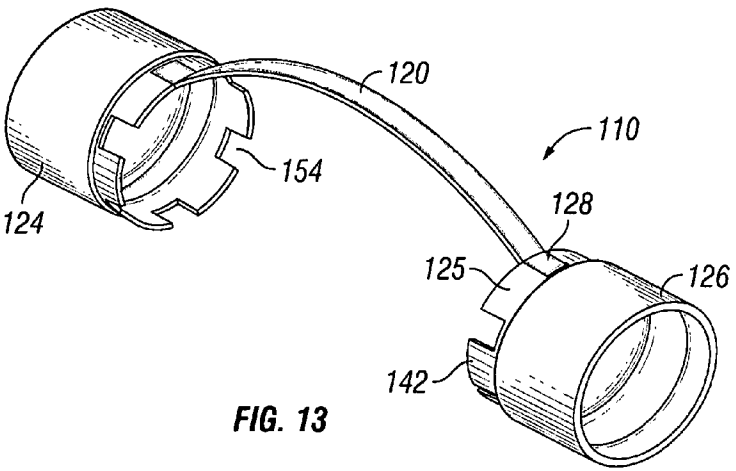
FIG. 13 is a perspective view of a fifth embodiment of a bow spring centralizer constructed in accordance with the teachings of the present invention; only a single bow spring is shown for purposes of clarity.

Referring now to FIGS. 13 and 14, there is shown a centralizer 110 adapted for concentric mounting on a sub 112 or other tubular member. Sub 112 is provided with a shoulder 162, or in the embodiment shown, first and second shoulders 162, on the outer surface, or O.D., 116 thereof. Centralizer 110 comprises first and second collars 124, 126, the ends 128 of a plurality of bow springs 120 being affixed to each of collars 124, 126 by, for instance, welding or other suitable means of attachment. Although not shown in FIGS. 13 and 14, those skilled in the art who have the benefit of this disclosure will recognize that one or both of collars 124, 126 move along the length of sub 112 when the bow springs 120 are compressed from a first, bowed position standing off from sub 112 to a second, compressed position closer to sub 112 as centralizer 110 performs its function of maintaining stand-off between a tubing string and the wall of a wellbore. A groove 118 is provided in the inside diameter, or I.D., of each of collars 124, 126 that is adapted for receiving the shoulders 162 formed on sub 112, and depending upon the amount of bow in bow springs 120 and the spacing between the shoulders 162, the groove 118 functions as a stop that abuts one or both of the shoulders 162 when the collars 124, 126 move longitudinally along sub 112 to limit movement relative to sub 112 when the bow springs 120 are compressed by contact with the inside diameter of another, larger daimeter member such as the casing (not shown in FIG. 13 or 14 but described in detail in connection with FIGS. 5 and 6, above) in the wellbore.

Those skilled in the art will recognize from this description that both of the collars 124, 126 of centralizer 110 need not be provided with grooves 118. In an alternate embodiment (not shown), just one or the other of collars 124, 126 is provided with a groove and the shoulder 162 of sub 112, rather than limiting movement of both collars 124, 126, limits movement of just one collar along the length of sub 112. It will also be apparent from this description that limiting movement of one or both of collars 124, 126 along the length of sub 112 also limits longitudinal movement of the entire centralizer along the length of sub 112. It will also be recognized from this disclosure that the shoulder 162 need not be continuous (e.g., extend all the way around the entire O.D. of sub 112) to function for the intended purpose and/or that one or more lugs that interact with a detent, notch, or cutout formed in the I.D. of collar(s) 124, 126 as described and shown in U.S. Pat. No. 6,209,638, hereby incorporated into this specification in its entirety by this reference thereto, will also function to limit movement of collar(s) 124, 126 along the length of sub 112.

In the embodiment shown in FIGS. 13 and 14, each of collars 124, 126 is provided with a portion 125 of reduced outside diameter to which the ends 128 of bow springs 120 are welded so that the ends 128 of bow springs 120 are flush with the O.D. of the collars 124, 126. In the embodiment shown in FIGS. 13 and 14, the opposed margins 142 of collars 124, 126 are provided with a plurality of notches 154 formed in the reduced diameter portions 125. Although both arrangements are contemplated by the present invention, the ends 128 of bow springs 120 shown in FIGS. 13 and 14 are welded to the collars 124, 126 in the notches 154 instead of being welded to the surface, or O.D., of the reduced diameter portion 125 of first and second collars 124, 126. Welding the ends 128 of bow springs 120 into notches 154 reduces the effective diameter of centralizer 110 by at least the thickness of the metal comprising the springs 120, thereby enabling the use of centralizer 110 in smaller diameter boreholes and/or for running through restrictions in the wellbore (and/or through the wellhead or flow control equipment). It will also be apparent that the same result can be achieved without a reduction in the diameter of collar(s) 124, 126 by welding the ends 128 of bow springs 120 into notches formed in the opposed margins 142 of collar(s) 124, 126. For increased strength in the attachment of the ends 128 of bow springs 120 into the notches 154, the edges of both the ends 128 of bow springs 120 and the notches 154 may be provided with complimentary bevels, the wider portion of the beveled edges of the ends 128 of bow springs 120 being captured and retained in notches 154 by the narrower portion of the beveled edges of the notches 154 in the reduced diameter portion 125 of collars 124, 126.

Those skilled in the art who have the benefit of this disclosure will recognize that the reduced diameter portions 125 of collars 124, 126, and the notches 154, need not be formed in the opposed margins 142 of collars 124, 126. The centralizer of the present invention will also function for its intended purpose if the reduced diameter portions 125 of collars 124, 126, and the notches 154, are formed in the ends of collars 124, 126 opposite the opposed margins 142.

Although the invention is not so limited, depending upon the thickness of the metal comprising bow springs 120 and/or collars 124, 126, a reduction in the diameter of centralizer 120 in the neighborhood of one quarter to three eighths of an inch is achieved with typical materials and construction (the reduction results from a reduction of approximately one eighth of an inch, using typical construction, around the entire circle of the centralizer for a total reduction of approximately one quarter of an inch). This reduction in the diameter of centralizer 120 helps achieve the goal of facilitating the passage of centralizer 120 through reduced diameter portions of the wellbore and/or through wellhead and/or flow control equipment during the running of the centralizer into or out of the wellbore. The decrease in diameter has the additional benefit of not requiring the bow springs 120 to be compressed as much as in previous known centralizers, thereby decreasing the likelihood that the bow springs will be compressed beyond their ability to return to their first, uncompressed position standing off from the O.D. of sub 112, in other words, without compromising the restoring force of the bow springs 120.

In the embodiment shown in FIGS. 13–14, as with the centralizers 56, 58, 60, and 64 shown in FIGS. 9–12, the rotating bow spring assembly (comprised of collars 124, 126 and bow springs 120) may be spaced longitudinally on the sub 112 from a set of vanes (not shown) on the O.D. of sub 112. The centralizer 110 is retained in this longitudinally spaced position on sub 112 by engagement of the shoulders 162 formed on sub 112 by the grooves 118 in the I.D. of collars 124, 126 in the manner described above. Because of the presence of both the bow springs 120 and the vanes (not shown), the embodiment 110 shown in FIGS. 13 and 14 is capable of performing in the same manner as the embodiment shown in FIGS. 1–6 to maintain fluid flow and stand-off from the I.D. of the borehole, but has the additional advantage of allowing rotation of the centralizer 110 (and hence a tubing string) relative to sub 112. Those skilled in the art who have the benefit of this disclosure will recognize that in a manner similar to that described above in connection with the embodiment 60 shown in FIG. 11, the vanes of the sub 112 may be angled and spiraled so as to "turbolate" fluid flow past centralizer 110, thereby assisting in maintaining fluid flow in the borehole.

It will also be recognized by those skilled in the art that the embodiment 110 shown in FIGS. 13 and 14 can be constructed so as to prevent relative rotation between sub 112, and hence, a tubing string (not shown) and the centralizer 110. Referring again to FIGS. 1–6, it can be seen that the sub 112 can be provided with one or more cut-out(s) (not shown) spaced radially around the opposed margins 142 of collars 124, 126 and the sub 112 can be provided with one or more vane(s) such as the vanes 36 mounted on body 12 in FIGS. 1–6, with the cut-out(s) in collars 124, 126 receiving the end of the vane(s), thereby preventing relative rotation between sub 112 and the centralizer 110 assembly (the latter being comprised of bow springs 120 and collars 124, 126) in the same manner as described above in connection with the embodiment shown in FIGS. 1–6. Similarly, the depth of the cut-out(s) and/or length of the vane(s) is such that, when the bow springs 120 move from the first, bowed position to the second compressed position in the grooves between vanes and first and second collars 124, 126 move apart from each other, the collars 124, 126 do not rotate relative to sub 112. In short, relative rotational movement between sub 112 and centralizer 110 is prevented when the bow springs 120 are in both their first, bowed and their second, compressed positions by the interaction of the vane(s) and cut-out(s) in the margins 142 in the same manner as described in connection with the embodiment 10 shown in FIGS. 1–6.

Those skilled in the art who have the benefit of this disclosure will recognize that certain changes can be made to the component parts of the apparatus of the present invention without changing the manner in which those parts function to achieve their intended result. For instance, although the vanes 36 are described herein as being welded to the outside surface 16 of body 12 of the centralizer of the present invention such that it is clear that in the presently preferred embodiment, the vanes 36 are comprised of relatively incompressible metal, those skilled in the art who have the benefit of this disclosure will recognize that vanes 36 may also be comprised of materials other than metal. Further, in certain applications, it may be advantageous to make the vanes 36 of a material that is slightly compressible or even elastically deformable when compressive forces are exerted against the vanes. A variety of polymeric materials are available, for instance, that are high temperature tolerant, or acid resistant, or have other desirable physical properties that will enable them to serve this function. Those skilled in the art who have the benefit of this disclosure will also recognize that, although the preferred embodiment of the centralizer of the present invention has been described herein as being used in a wellbore, the use of the centralizer of the present invention is not so limited. A centralizer constructed in accordance with the teachings of the present invention may be used in any application in which it is desirable to maintain minimum standoff between two concentric tubular members and/or center one tubular member inside another.

Similarly, U.S. Pat. No. 5,575,333 discloses several embodiments of a bow spring centralizer that vary, inter alia, in the configuration of the bow springs and their attachment to the body of the centralizer. To illustrate how the structure disclosed in that patent can be incorporated into the centralizer of the present invention, one embodiment of the centralizer disclosed in that patent lacks collars altogether, the bow springs being attached directly to the outside surface of the body of the centralizer and the ends of the bow springs moving in grooves when the bow springs are compressed. Similar grooves can be provided in the surface 16 of the body 12 of the centralizer of the present invention for receiving the bow springs 20 described herein. Those skilled in the art will recognize that the other structural variations shown in that patent can also be utilized in connection with the centralizer of the present invention. For that reason, U.S. Pat. No. 5,575,333 is incorporated into this specification in its entirety by this reference thereto. Similarly, those skilled in the art will recognize that, as also described in that same U.S. Pat. No. 5,575,333, the centralizer of the present invention will function for its intended purpose with but one of the two collars 24, 26. Likewise, U.S. Pat. No. 3,556,042 discloses a bow spring centralizer in which the collar/bow spring assembly is provided with slightly-bowed so-called inner strips that connect the collars under the bow springs so that compression of the bow springs is resisted. That same patent also discloses a centralizer having a bow spring with a double arc that is used to advantage in connection with the centralizer of the present invention. Because of this disclosure, U.S. Pat. No. 3,556,042 is also incorporated into this specification in its entirety by this specific reference thereto. The alternative embodiments resulting from the incorporation of the structural features of these two patents that are incorporated herein by reference, and other changes that will be made clear to those skilled in the art by this description of the preferred embodiments of the invention, are intended to fall within the scope of the following, non-limiting claims.

What is claimed is:

1. A centralizer adapted for concentric mounting on a sub, the sub having a shoulder formed on the outside diameter thereof, comprising:

a collar;

a groove in the inside surface of said collar adapted for receiving the shoulder formed on the outside diameter of the sub therein when concentrically mounted to the sub to limit longitudinal movement of said collar along the sub;

said collar having a portion of reduced outside diameter; and a plurality of bow springs, one end of each of said bow springs being mounted to said reduced diameter portion of said collar, each of said bow springs being movable between a first, bowed position standing off from the sub to a second compressed position closer to the sub.

2. The centralizer of claim 1 additionally comprising a second collar, said second collar having a reduced diameter portion to which the second end of each of said bow springs is mounted.

3. The centralizer of claim 2 additionally comprising a plurality of notches formed in said reduced diameter portions of said collars, the ends of each of said bow springs being mounted in the corresponding notches of said collars.

4. The centralizer of claim 2 wherein the width of the grooves in said collars is sized to limit longitudinal movement of said collars along the sub in a direction apart from each other.

5. The centralizer of claim 4 wherein the margins of each of said notches are beveled for receiving a complimentary bevel in the end of each of said bow springs.

6. The centralizer of claim 1 additionally comprising a plurality of notches formed in said reduced diameter portion of said collar, the end of each of said bow springs being mounted in a corresponding one of said notches.

7. The centralizer of claim 1 additionally comprising a plurality of notches formed in the reduced diameter portion of said collar, the ends of each of said bow springs being mounted in the corresponding notches of said collar.

8. An apparatus for centralizing a tubular member comprising:

a tubular member;

a collar mounted concentrically on said tubular member;

a shoulder formed on said tubular member;

a groove formed in the inside surface of said collar for receiving the shoulder on said tubular member to limit longitudinal movement of said collar on the tubular member and to provide rotational movement of said collar on the tubular member;

a plurality of bow springs, one end of each of said bow springs being mounted to said collar, each of said bow springs being compressible from a first, bowed position standing off from said tubular member to a second compressed position closer to said tubular member.

9. The apparatus of claim 8 wherein said collar is provided with a reduced diameter portion to which the ends of each of said bow springs are mounted.

10. The apparatus of claim 9 wherein said collar is provided with a plurality of notches formed in the reduced diameter portion thereof, the ends of each of said bow springs being mounted in the corresponding notches of said collar.

11. The apparatus of claim 8 wherein said collar is provided with a plurality of notches, the ends of each of said bow springs being mounted in the corresponding notches of said collar.

12. The apparatus of claim 8 additionally comprising a second collar concentrically mounted to said tubular member and having the second end of each of said bow springs mounted thereto.

13. The apparatus of claim 12 wherein said tubular member is provided with a shoulder received within an annular groove formed in said second collar.

14. The apparatus of claim 13 wherein the spacing of the shoulders formed on said tubular member is such that the shoulders limit longitudinal movement of said collars along the length of said tubular member.

15. The apparatus of claim 8 wherein said shoulder extends continuously around the outer diameter of said tubular member.

16. The apparatus of claim 8 wherein said shoulder comprises one or more lugs.

17. An apparatus for centralizing a tubular member comprising:

a tubular member having spaced apart annular shoulders formed thereon;

first and second collars mounted concentrically on said tubular member;

a groove formed in said collars for receiving the respective shoulders on said tubular member to limit movement of said collars along the length of said tubular member;

a plurality of bow springs, one end of each of said bow springs being mounted to each of said collars, each of said bow springs being compressible from a first, bowed position standing off from said tubular member to a second compressed position closer to said tubular member.

18. The apparatus of claim 17 wherein said collars are provided with reduced diameter portions to which the ends of each of said bow springs are mounted.

19. The apparatus of claim 18 wherein said collars are provided with a plurality of notches formed in the reduced diameter portions thereof, the ends of each of said bow springs being mounted in the corresponding notches of said collars.

20. The apparatus of claim 17 wherein said collars are provided with a plurality of notches, the ends of each of said bow springs being mounted in the corresponding notches of said collars.

* * * * *